US007337903B2

(12) United States Patent
Lauri

(10) Patent No.: US 7,337,903 B2
(45) Date of Patent: Mar. 4, 2008

(54) SINGLE EDGE RAZOR BLADE HOLDER

(76) Inventor: Aaron P. Lauri, 3630 Huron St., Dearborn, MI (US) 48124

( * ) Notice: Subject to any disclaimer, the term of this patent is extended or adjusted under 35 U.S.C. 154(b) by 546 days.

(21) Appl. No.: 10/752,392

(22) Filed: Jan. 6, 2004

(65) Prior Publication Data

US 2004/0200080 A1 Oct. 14, 2004

Related U.S. Application Data

(60) Provisional application No. 60/438,413, filed on Jan. 7, 2003.

(51) Int. Cl.
*A45D 27/24* (2006.01)
*B65D 83/10* (2006.01)

(52) U.S. Cl. ..... 206/350; 206/352; 206/818; 30/541

(58) Field of Classification Search ..... 206/350, 206/352, 818; 30/541
See application file for complete search history.

(56) References Cited

U.S. PATENT DOCUMENTS 1,654,554 A * 1/1928 Pasch ..... 206/350
2,414,653 A * 1/1947 Lookholder ..... 335/285
3,337,100 A * 8/1967 Berning ..... 224/182
3,667,122 A * 6/1972 Black ..... 30/286
5,025,966 A * 6/1991 Potter ..... 224/183
5,139,167 A * 8/1992 McCarthy ..... 221/312 A
5,148,916 A * 9/1992 Tillyer, Sr. ..... 206/352
6,457,252 B1 * 10/2002 Kershner ..... 33/760
6,824,028 B2 * 11/2004 Mutai et al. ..... 224/271

FOREIGN PATENT DOCUMENTS

FR 2460643 A * 3/1981

* cited by examiner

*Primary Examiner*—Mickey Yu
*Assistant Examiner*—Jerrold Johnson
(74) *Attorney, Agent, or Firm*—Michael Bak-Boychuk

(57) ABSTRACT

A razor blade holder includes a slotted housing for removably retaining a razor blade therewithin. The housing accommodates at least one magnet. The housing is used conjointly with a keeper having a magnet affixed thereto. The housing and keeper, in use, sandwich a portion of a garment therebetween to provide easy and safe access to a razor blade. The magnets used herein are preferably neodymium magnets. Also, the present invention is particularly adapted for use with a single edge razor.

6 Claims, 3 Drawing Sheets

FIG 4A
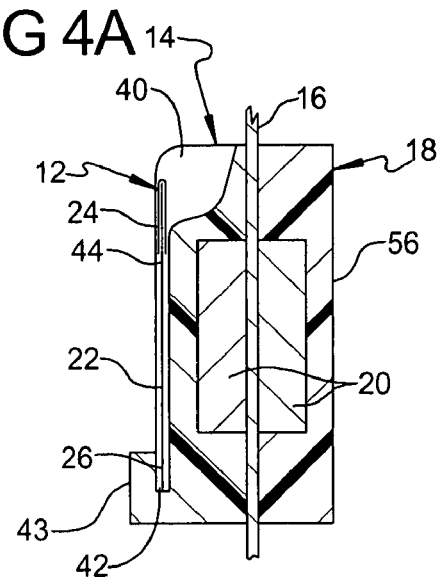
FIG 4B
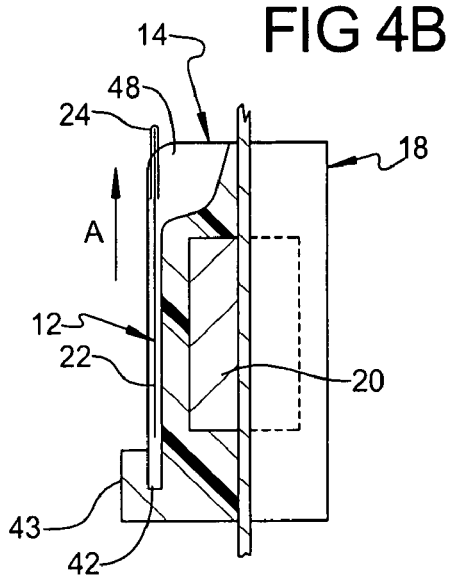
FIG 4C
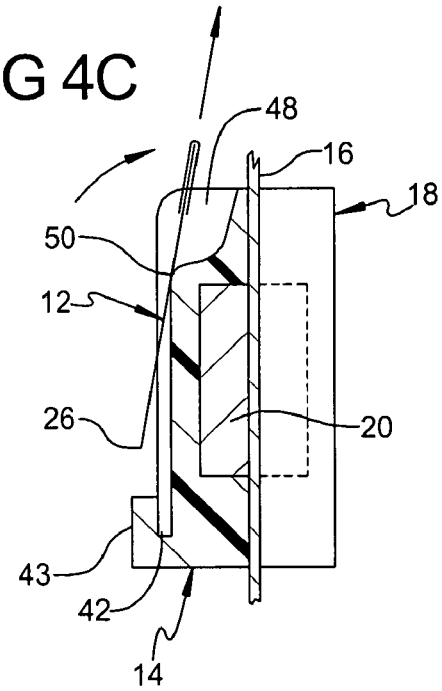
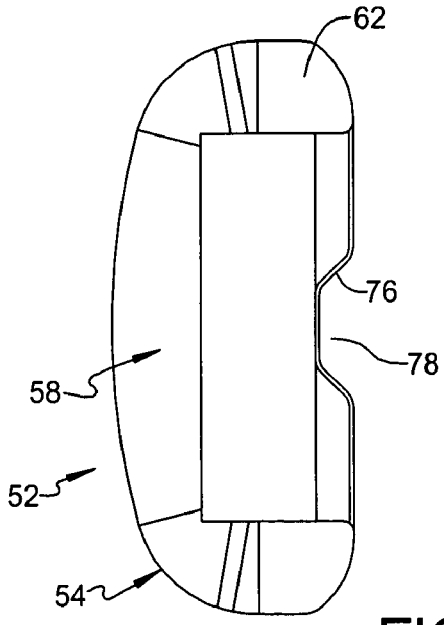
FIG 6

FIG 5
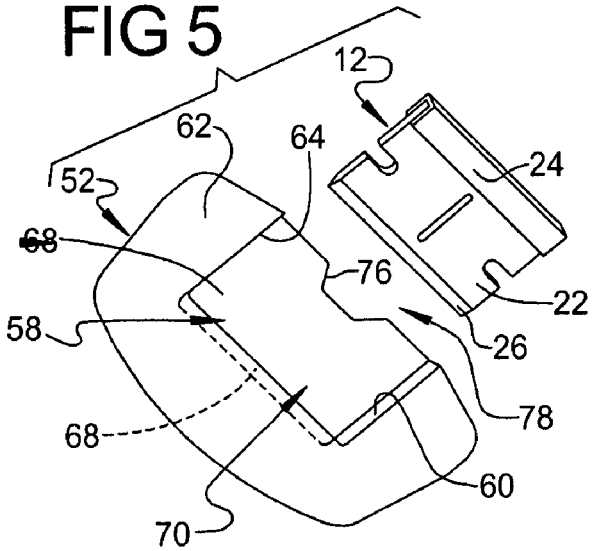
FIG 7
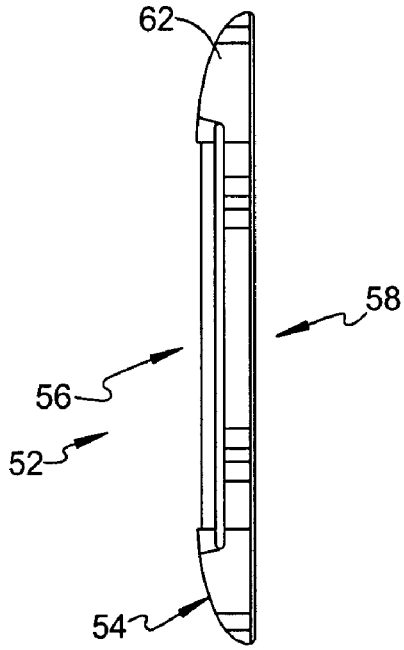
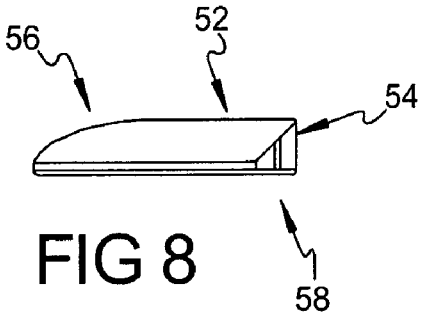
FIG 8
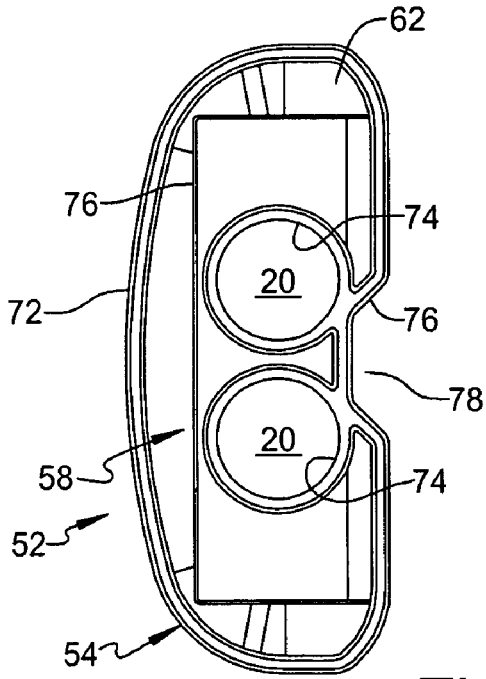
FIG 9

SINGLE EDGE RAZOR BLADE HOLDER

CROSS REFERENCE TO RELATED APPLICATIONS

This application is a completion application of and claims the benefit of copending U.S. Patent Application, Ser. No. 60/438,413, filed Jan. 7, 2003, for "SINGLE EDGE RAZOR BLADE HOLDER", the disclosure of which is hereby incorporated by reference.

BACKGROUND OF THE INVENTION

1. Field of the Invention

The present invention relates to a single edge razor blade storage, transport, and dispensing device that offers convenience and access to a razor blade such as when hanging wallpaper or in a scraping operation.

2. Description of the Prior Art

The use of single edged razor blades and blade holders and/or containers for transport, storage and dispensing of these blades is known in the art. Additionally, the use of a magnetic device for holding the blade is known.

By way of example, attention is drawn to U.S. Pat. No. 1,299,097 issued Apr. 1, 1919 to Ames; U.S. Pat. No. 2,370,815 issued Mar. 6, 1945 to Ross; U.S. Pat. No. 2,643,579 issued Jun. 30, 1953 to Jacoby; U.S. Pat. No. 3,067,513 issued Dec. 11, 1962 to Randol; U.S. Pat. No. 3,358,367 issued Dec. 19, 1967 to Bartley; U.S. Pat. No. 3,660,894 issued May 9, 1972 to Sand; and U.S. Pat. No. 5,479,950 issued Jan. 2, 1966 to Andrews.

An improved arrangement that enables the transport, storage, protection, and dispensing of a single edged razor blade by a craftsman would be desirable. Additionally, an arrangement that utilizes a magnetic device for holding the blade and also makes the safety razor blade directly available to an individual when working in remote areas would be desirable.

SUMMARY OF THE INVENTION

According to this invention, embodiments of a blade holder for holding a razor blade having a single cutting edge are disclosed. Preferably, the blade holder comprises a housing of non-magnetic material. The housing is formed with upper and lower end walls, a front side, a vertical channel opening outwardly along the front side of the housing, and a groove or chamber extending across the lower end wall. The channel and groove have a width that is greater than the width of the blade, and the slot groove communicates with or opens into the channel and has a depth sized to receive and conceal the cuffing edge of the blade. A magnet is embedded in the housing for attracting and removably holding or retaining the razor blade, where desired, against the front side of the housing when the blade is disposed in the channel.

Preferably, to enable centering, placement, and removal of the blade, a pair of sidewalls that project forwardly from the front side of the housing define the vertical channel on the front side that receives the razor blade. The forward extension of the sidewalls is greater than the thickness of the blade.

In one preferred embodiment according to this invention, the front side is divided into upper and lower portions with the transition between the portions defining a fulcrum against which the blade may pivot. The upper portion between the upper end wall and the fulcrum is concave and the surface tapers (i.e., slopes) outwardly from the back side in extending between the upper end wall and the fulcrum. The lower portion is substantially flat or generally planar and sized to position the blade thereon.

In another preferred embodiment according to this invention, the front side is generally flat (or planar), and the upper end wall has a central portion between the sidewalls that is concave. The concave central portion extends towards the lower end wall to form a cut-out region that allows a user's finger to be received therewithin to grip the upper edge portion of the razor blade, either for placement or removal.

Preferably and according to an important aspect of this invention, there is provided apparatus for attaching and carrying a single edged razor blade on clothing, the apparatus comprising the blade holder, as described herein above, and a keeper. The keeper is of a non-magnetic material provided with a magnet. The magnets in the holder and the keeper are such that the holder and the keeper will be held in gripped relation when brought in to into contact with one another. In use, a garment may be sandwiched between the holder and the keeper.

Preferably and according to this invention, the magnet is comprised of the element Neodymium. As applied herein, the Neodymium magnet is made up of a compound called NIB, for Neodymium Iron Boron ($Nd_2Fe_{14}B$), and formed into a cylindrical or disc shaped form.

Further, preferably two cylindrical Neodymium magnets are provided in the holder and in the keeper. However, in some applications, one magnet may be adequate. Additionally, other shapes (such as rectangular slab) and other magnetic materials may be utilized.

In a related aspect, there is provided in herein a kit for enabling a single edged razor blade to be removably secured to a garment and transported for use where desired. According to this aspect, the kit comprises the keeper as described herein above, the keeper including at least one magnet, the blade holder, as described herein above, the holder including at least one magnet, and a single edged razor blade.

Further and according to another aspect of the invention herein, a method of storing, carrying and using a razor blade of the type having a single cutting edge is disclosed. The method comprises the steps of:

(a) providing a holder having a magnet therein and a keeper having a magnet therein, the holder being formed to include on a front side thereof a vertical channel for receiving the blade and a fulcrum to enable the blade to pivot relative to the front side, and a slot for receiving the cutting edge of the blade, (b) positioning the keeper and holder on opposite sides of a garment whereby the magnets will attract to one another and the garment will be sandwiched the holder and the keeper, and for storage, (c) inserting a razor blade into the channel whereby the holder magnet will attract and retain the blade in the channel and against the front side of the holder, (d) for use, (i.) forcing the razor blade vertically upward in the channel such that the fulcrum is positioned generally medially of the blade, and (ii.) substantially simultaneously with the forcing, pushing the upper half of the blade towards the front side and pulling the lower half of the blade upwardly in the channel, the inward pushing freeing the hold of the magnet on the razor blade.

The present invention will be more clearly understood with reference to the accompanying drawings and to the following detailed description, in which like reference numerals refer to like parts.

BRIEF DESCRIPTION OF THE DRAWINGS

FIGS. 4A, 4B, and 4C are section views of the blade holder and associated keeper attached to a garment and illustrate a single edged razor blade, respectively, when in a retained position for carrying, an intermediate stage in removal, and the removal of the blade from the blade holder.

FIG. 5 is a perspective exploded view of another exemplary preferred blade holder according to this invention and a single edged razor blade being positioned for receipt in a channel of the blade holder.

FIGS. 6-9 are, respectively, a top plan, a front elevation, a side elevation, and a bottom plan view of the blade holder of FIG. 5.

DETAILED DESCRIPTION OF THE PREFERRED EMBODIMENT

Figure 1:
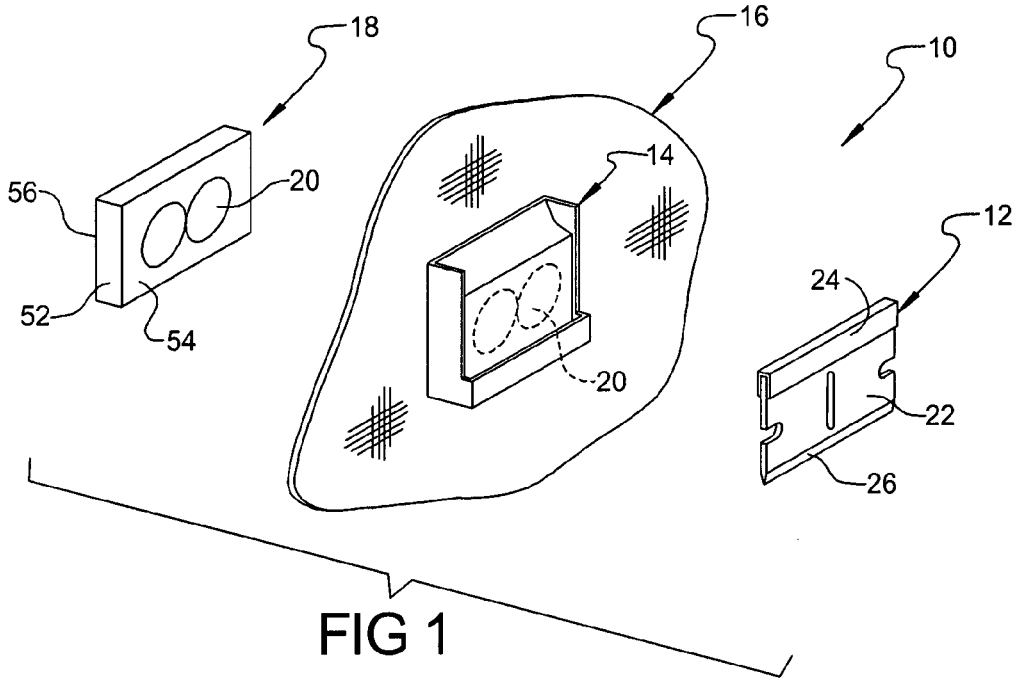
FIG. 1 is a perspective exploded view of an exemplary preferred blade holder and associated keeper according to this invention being positioned for removable attachment to a garment and a single edged razor blade positioned for retention to the blade holder.

Turning to the drawings, FIG. 1 illustrates apparatus and a method of use of apparatus 10 that enables a worker to safely carry and store a safety edge razor blade 12 when not in use as well as permit easy access to and removal of the blade for use. Although the invention is not to be construed as so limited, the present invention enjoys particular utility by a window washer, painter or other practitioner who needs easy access to a razor blade, but also needs safe storage thereof.

According to an exemplary preferred embodiment, a blade holder 14 for storing, carrying, and dispensing the razor blade 12 is positioned on the exterior of a garment 16 of cloth or like material worn by a worker and placed in juxtaposition with a keeper 18 positioned on the other side of the garment. The blade holder 14 and keeper 18 are each provided with at least one magnetic member 20 that enables each to be magnetically attracted and fastened to one another and sandwich the garment 16 therebetween.

According to an important aspect of this invention, the razor blade 12 is of a suitable magnetically attachable material, such as an industrial quality high carbon, or stainless steel and the like. Preferably, the razor blade 12 is a conventional single edge industrial blade that fits standard tools satisfying a wide variety of home and professional scraping and cutting needs, such as for removing coatings, paint and stickers from glass, mirrors, and windshields, and installing wallpaper.

In the embodiment shown in FIG. 1, the blade 12 comprises a thin, generally rectangular, blade element 22 having a pair of short, non-cutting lateral edges, a reinforcement band 24 secured along the top edge of the blade element, and a cutting edge 26. The reinforcement band 24 and the cutting edge 26 extend between the non-cutting edges of the blade element and the cutting edge 26 is spaced from the reinforcement band 24. The blade element 22 is about 40 mm by 20 mm (or about 1.575" by 0.787"), the cutting edge 26 has a thickness of about 0.23 mm (about 0.009"), and the central body portion of the blade is about 0.304 mm (or about 0.012") and provided with tool alignment features, such as a central slot and notches in the lateral non-cutting edges. The reinforcement band 24 has a thickness of about 1 mm (or about 0.039") when fastened about the top of the blade element 22

Figure 2:
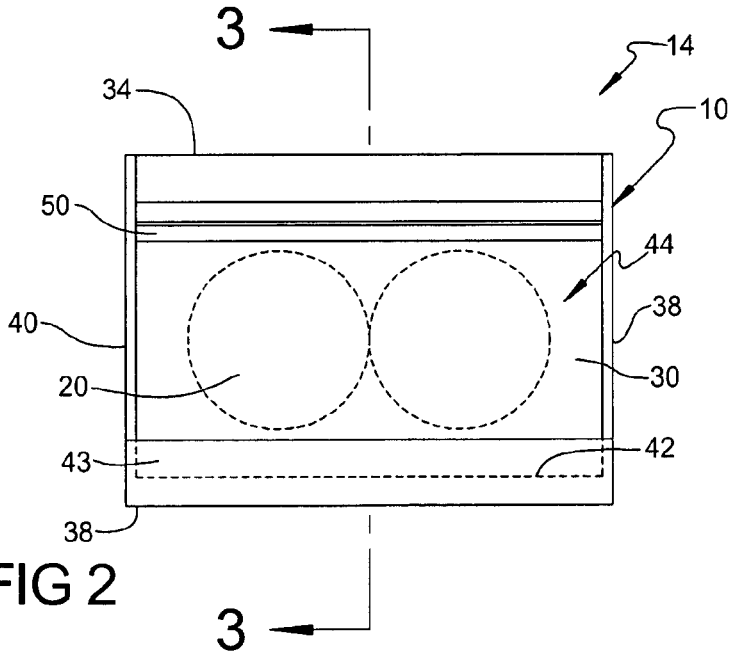
FIG. 2 is a plan view showing the front of the blade holder of FIG. 1.
Figure 3:
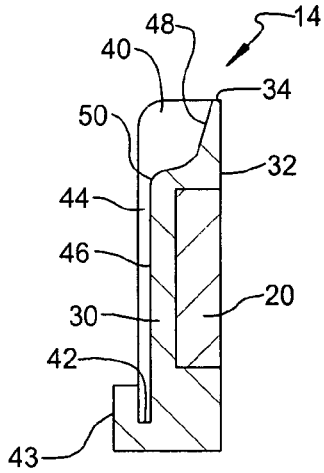
FIG. 3 is a sectional view taken along line 3-3 of FIG. 2.

According to this invention, and referring to FIGS. 2 and 3, the blade holder 14 comprises a housing 28 having a front and back side 30 and 32, an upper end wall 34, and a lower end wall 36 spaced from the upper wall. The housing 28 is preferably formed of a non-magnetic material, such as a suitable plastic, to include a pair of sidewalls 38 and 40 and an elongated groove (e.g., chamber or recess) 42. The sidewalls 38 and 40 project forwardly from the front side 30 by a dimension that is greater than the greatest thickness of the razor blade 12 at the reinforcement band 24 and define an forwardly open vertical channel 44 on the front side of the holder 14. The channel 44 is slightly wider than the width of the blade between the non-cutting edges thereof and is sized to receive the blade in a clearance fit.

The groove 42 is formed by a guard wall 43 that is spaced from the front side 30, the guard wall extending between the sidewalls 38 and 40 and upwardly from the lower end wall 36. The groove 42 thus formed across the front side 30 of the housing 28 forms a continuation of the vertical channel 44. The groove 42 has a transverse dimension or width that is greater than the thickness of the blade element 22 and a depth sufficient to receive, cover, conceal, and protect the cutting edge 26 of the razor blade 12.

According to one embodiment, the sidewalls 38 and 40 are spaced about 2 inches apart, the upper and lower end walls 34 and 36 are spaced about 1 1/16 inches apart, the guard wall 43 is about 3/16 inch, and the slot 42 has a width of about 1/16 inch and covers about 1/16 inch of the cutting blade 26.

The front side 30 of the blade holder housing 28 is divided into generally vertically extending lower and upper portions 46 and 48. The lower portion 46 is generally planar and parallel to the plane of the back side 32 and provides a surface for supporting the blade element 22. Further, the lower portion 46 is dimensioned to be slightly less than the height of the razor blade 12 (i.e., the distance between the cutting edge 26 and the edge of the reinforcement band 24).

Preferably and according to an important aspect of this invention, the upper portion 48 extends downwardly and outwardly from the upper wall 34 and intersects the lower portion 46. That is, the upper portion 48 between the upper wall 34 and the lower portion 46 is contoured, undergoes a change in thickness, and is concave. The location where the portions 46 and 48 intersect forms a fulcrum 50 that extends laterally between the sidewalls 38 and 40 and enables the razor blade 12 to be pivoted (i.e., rotated) relative to the front side 30 of the housing 28.

As will be described hereinbelow, upward vertical advance of the razor blade 12 in the channel 44 formed between the sidewalls 38 and 40 causes the reinforcement band 24 to advance above the fulcrum 50 and be superposed above a concave region. Inward force against the band 24 towards the upper portion 48 will cause the razor blade 12 to pivot relative to the fulcrum 50 and the blade element to be pulled from the retaining attraction of the magnets 20.

Importantly and critical to the practice of this invention, at least one and preferably two generally cylindrical disc-shaped magnets 20 are provided in the housing. In one embodiment, each magnet is about ½ inch in diameter, and about ⅛ inch thick.

Preferably, the magnets 20 are integrally molded or otherwise embedded into the housing 28 and the two magnets disposed in a side-by-side contacting engagement with one another. That is, the outer circumferences of the two magnets 20 touch one another whereby to maintain a flux path and the magnetic field therebetween.

Preferably, the magnets 20 are comprised of the element Neodymium (element number 60 on the Periodic Table). As applied herein, the Neodymium magnet is made up of a compound called NIB, for Neodymium Iron Boron ($Nd_2Fe_{14}B$), one of the strongest known ferromagnetic materials. Importantly, such magnet has a higher Gauss than ordinary household magnets and remains more permanent with little or no loss of magnetic pull for over perhaps a ten-year period.

Further, in some applications, only one magnet may be adequate. Additionally, other shapes than the cylindrical disc shown (such as rectangular slab) and other magnetic materials may be utilized.

The keeper 18 comprises a generally rectangular housing 52 having front and back sides 54 and 56. The keeper 52 is formed of a non-magnetic material, such as a suitable plastic, and provided with at least one and preferably two generally cylindrically shaped magnets 20. Preferably, the magnets 20 are integrally molded or otherwise embedded into the keeper housing 52 and disposed in a side-by-side contacting engagement with one another such that the outer circumferences of the two magnets touch one another. As with the header, the magnets 20 are, preferably, neodymium magnets.

Referring to FIGS. 4A, 4B, and 4C, a method of using the apparatus 10 herein is illustrated. As shown in FIG. 4A, the front side 54 of the keeper 18 is placed on one side of the garment 16 and juxtaposed with the back side 32 of the holder 14. The magnets 20 in the keeper 18 and in the holder 14 are juxtaposed with one another. Due to magnetic attraction between the two pairs of magnets 20, the keeper 18 and the holder 14 are held together.

The razor blade 12 is inserted into the channel or passageway 44 formed between the sidewalls 38 and 40 of the holder 14 such that the cutting edge 26 is disposed inwardly of the slot 42 and the reinforcement band 24 is generally medially of the fulcrum 50. The magnets 20 in the holder retain the razor blade 12 in place, in the channel 44, against the front side 30, for storage, protection and/or carrying, even if the cutting edge 26 is outwardly of the protective slot 42.

As shown in FIG. 4B, when the worker needs to remove the razor blade 12 for use, the worker places a finger (shown in phantom) against the blade element 22, and forces the blade vertically upward (in the direction of the arrow "A"). This movement causes the reinforcement band 24 to be moved above the fulcrum 50. The magnets 20 in the blade holder 14 operate to retain the blade element 22 against the lower portion 46 of the front side 30.

Finally, as shown in FIG. 4C, the razor blade 12 is simultaneously moved upwardly and the reinforcement band 24 forced inwardly and towards the upper portion 48 of the front side (in the direction of the arrow "B"). This combined movement causes the blade element 22 to pivot relative to the fulcrum 50 and be free from the grip of the magnets 20. This enables the user to grip the razor blade 12 relative to the reinforcement band 24 and remove the razor blade from the blade holder 14.

In a related aspect, there is thus provided herein a kit for enabling a single edged razor blade 12 to be removably secured to a garment 16 and transported for use where desired. The kit comprises a keeper 18, as described herein above, the keeper including at least one magnet 20, a blade holder 14, as described herein above, a holder 14 including at least one magnet 20, and a razor blade 12 having a single cutting edge 26.

In the use of the kit, and according to this invention herein, a method of storing, carrying and using a razor blade of the type having a single cutting edge is disclosed. The method comprises the steps of providing a holder, keeper and single edged cutting edge, the keeper and holder having respective magnets for retaining each together and the blade onto the front side of the holder. The keeper and the holder are positioned on opposite sides of a garment whereby the magnets will attract to one another and the garment will be sandwiched the holder and the keeper.

For blade carrying and storage, the cutting edge of razor blade is positioned towards the slot and the razor blade moved downwardly and inserted into the channel. The magnet will then attract and retain the blade in the channel and against the front side of the holder.

For blade use, the razor blade is forced or pushed vertically upward in the channel and along the front side such that the fulcrum is positioned generally medially of the blade and the reinforced band is positioned over the concave upper portion of the sidewall. The upper half of the blade is pushed upwardly and the reinforcement band portion thereof forced inwardly and towards the front side of the holder in a simultaneous motion thereby pulling the lower half of the blade from magnetic engagement with the channel wall. This disengagement enables the user to remove the razor blade from the blade holder and for use.

Turning now to FIGS. 5-9, an alternate preferred embodiment of a blade holder 52 according to this invention is disclosed. The blade holder 52 is adapted to receive, center, position, and enable easy removal of a singled edged razor blade 12 as described herein above.

The blade holder 52 is preferably integrally formed of a non-magnetic material and comprises a body 54 that has a front side 56 and a back side 58, a planar wall 60, and a U-shaped outer peripheral wall 62 on the front side 56. The U-shaped wall 62 projects outwardly from the wall 60 and defines a pair of laterally spaced sidewalls 64 and 66, a slot 68 extending between the sidewalls for receiving the cutting edge 26 of the blade 12, and a channel or recess 70 for receiving the blade element 22. The front surface of the channel 70 is formed by the wall 60 and is generally flat to provide a support surface against which the blade element 22 is positioned.

The back side 58 is configured to minimize the amount of material utilized. In this regard, the back side 58 is formed to include a peripheral (or outer) reinforcement rib 72, a pair of circular pockets or retention sockets 74, and a rectangular reinforcement rib 76 medially of the outer rib 72 and retention sockets 74. The retention sockets 74 are dimensioned to receive and seat a respective magnet 20 (as described herein above). While two circular sockets are shown, depending on the application, the geometry of the socket could be different (e.g., if the magnet were square) and the number of sockets could be other than two.

The magnets 20 may be firmly secured to the back side 58 and within their respective sockets 74 by a suitable adhesive. Further, if suitably dimensioned, the outer surface of the magnet and wall of the socket could be dimensioned to provide a strong frictional interference fitment.

Preferably and according to this embodiment, the planar wall 60 has an upper edge 76, which is configured to have a central portion 78 between the sidewalls 64 and 66 which is concave. The concave central portion 78 extends towards the slot 68 whereby to form a cut-out region that allows a user's fingers to be received therewithin to grip the upper edge portion 24 of the razor blade, whether for placement or removal.

It is to be understood that the blade holder 52 may be used with the keeper 18.

While shown and described with respect to a single edged razor blade, the invention is applicable to and can be used to temporarily hold other ferrous or magnetically attracted objects.

Further, while the blade holder 14 or 52 is shown as being generally flat and planar, the body of the blade holder can be provided, at least in part, with a portion that is slightly curved or suitably contoured. This non-planar portion will enable the blade holder to conform to a shaped surface defined by the garment and/or anatomy of the user against which the blade holder is to be carried or positioned when in use and inhibit the blade holder popping free from its retained securement when in use.

Having, thus, described the invention, what is claimed is:

1. A razor blade holder comprising:

a first housing comprising:

a front side comprising a substantially planar lower portion and a curved upper portion, the curved upper portion extending away from the plane of the lower portion so as to define a substantially straight intersection line at the intersection of the planar lower portion and the curved upper portion, the intersection line forming a fulcrum;

a pair of opposed sidewalls extending in a spaced relationship along the front side, the sidewalls and the front side defining an outwardly opening channel;

a guard wall extending between the pair of opposed sidewalls, the guard wall disposed at a spaced relation to the planar lower portion so as to form a groove between the planar lower portion and the guard wall; and at least one magnet embedded in the first housing for removably holding a razor blade in the channel and the groove while allowing manual translation of the razor blade relative to the front side of the housing and over the fulcrum.

2. The razor blade holder of claim 1 further comprising:

a second housing and at least one magnet secured to the second housing, the magnet being attractable to the at least one magnet of the first housing.

3. The razor blade holder of claim 2, which further comprises:

(a) a pair of magnets secured to the second housing, and (b) a pair of magnets embedded in the first housing.

4. The razor blade holder of claim 3 wherein each magnet is a neodymium magnet.

5. The razor blade holder of claim 1 wherein the at least one magnet is a neodymium magnet.

6. A method of removably storing a razor blade in a holder of claim 2 and about the body of a user comprising:

(a) placing a razor blade in the first housing;

(b) placing the first housing in contact with a first side of a garment; and (c) placing the second housing in juxtaposition with the first housing on the opposite side of the garment.

* * * * *